United States Patent [19]

Gabriele

[11] Patent Number: 5,009,510

[45] Date of Patent: Apr. 23, 1991

[54] SCRAPER MOUNTING ARRANGEMENT FOR FOOD PROCESS AGITATORS

[75] Inventor: Valentino Gabriele, Baltimore, Md.

[73] Assignee: J. C. Pardo and Sons, Baltimore, Md.

[21] Appl. No.: 588,855

[22] Filed: Sep. 27, 1990

[51] Int. Cl.[5] ..... B01F 11/00

[52] U.S. Cl. ..... 366/311

[58] Field of Search ..... 366/309, 310, 311, 312, 366/313; 15/246.5, 247; 99/348

[56] References Cited

U.S. PATENT DOCUMENTS

| | | | |
|---|---|---|---|
| 4,571,091 | 2/1986 | Pardo | 366/311 |
| 4,790,667 | 12/1988 | Pardo | 366/311 |
| 4,818,116 | 4/1989 | Pardo | 366/311 |

*Primary Examiner*—Robert W. Jenkins

*Attorney, Agent, or Firm*—Kenneth E. Darnell

[57] ABSTRACT

An arrangement for mounting scraper elements to portions of a mixing agitator such as an agitator intended to mix foods or other materials in a kettle either with or without heating of the materials, the mounting arrangement holds the scraper elements in scraping relation to interior walls of the kettle and biases the scraper elements against the kettle walls so that materials being mixed in the kettle are prevented from adhering to interior surfaces of the kettle. The mounting arrangement includes structure integral with the scraper element as well as structure mounted directly to the agitator and connecting to the scraper element for holding the scraper element in a desired location relative to the agitator and thus relative to the kettle walls. Further, the mounting arrangement includes a spring structure for resiliently biasing the scraper element against the kettle walls so that scraping contact is maintained on rotation of the agitator within the kettle. The mounting arrangement of the invention can be used with agitator devices of widely varying structure and varying rotational orientation within a kettle.

18 Claims, 3 Drawing Sheets

SCRAPER MOUNTING ARRANGEMENT FOR FOOD PROCESS AGITATORS

BACKGROUND OF THE INVENTION

1. Field of the Invention

The invention relates generally to mixing agitators useful with scraping elements and particularly to arrangements for mounting scraping elements to such agitators.

2. Description of the Prior Art

Agitator structures have long been used to mix foods, cosmetics, pharmaceuticals and many other materials in kettles or in containers of various shapes and sizes. Prior agitators have often been provided with scraping elements so that interior surfaces of the kettle or container could be continually scraped during the mixing process. In those situations wherein the materials to be mixed consist of liquids having suspended solids such as often occurs in the mixing of foods and especially foods which are being heated and/or cooked, it is necessary to gently and thoroughly mix the food materials without damaging the suspended solids. Agitators capable of mixing such materials with at least some degree of efficiency have previously been proposed. For example, Groen, Jr. in U.S. Pat. No. 3,752,057, describes an agitator having scraping elements which extend into the open end of a mixing kettle. The shaft upon which the Groen, Jr. agitator rotates extends diagonally into the kettle with the scraping elements being maintained in contact with interior surfaces of the kettle by virtue of an accurate placement of the agitator shaft relative to the kettle. Giusti, in U.S. Pat. No. 4,199,266, discloses an agitator mounted for rotation about a horizontal axis within a mixing kettle. Giusti provides scraping elements which are mounted in fixed positions on the agitator, the scraping elements of Giusti not being capable of pivotal movement by virtue of structure mounting the scraping elements to the agitator. Accordingly, the scraping elements of Giusti do not continuously "track" the interior surfaces of a kettle especially when these interior surfaces are "out of round". Brubaker, in U.S. Pat. No. 4,095,307, provides scraping elements on a mixing agitator, the scraping elements being spring biased to facilitate contact between walls of a container and the scraping elements. Pardo et al, in U.S. Pat. Nos. 4,571,091; 4,790,667; and 4,818,116 describe agitator structures having scraping elements which continuously track the interior surfaces of a kettle within which materials are being mixed, the scraping elements being resiliently biased into contact with interior surfaces of the kettle even when these interior surfaces are "out of round". The agitators of Pardo et al are particularly useful in mixing liquids having suspended solids and wherein the materials are being heated and/or cooked. The continual and substantially complete mixing and scraping action of the Pardo et al agitators facilitate suspension of solids in the mixture without damage to the solids and also act to prevent "burn-on" of food materials to walls of the kettle during mixing and/or cooking. The Pardo et al agitators exhibit extremely efficient mixing and scraping actions due in part to the ability of the scraping elements to maintain contact with interior walls of a kettle even when the kettles are not manufactured with perfectly spherical interior surfaces. The scraping elements of the Pardo et al agitators are contoured with scraping edges which conform to localized portions of interior surfaces of a kettle, the scraping elements being spring biased for pivotal movement to assure contact between the scraping edges and the surfaces of the kettle. The mounting arrangement of the invention provides all of the advantages of the prior art agitator/scraper combinations such as the Pardo et al structures while being of simple construction and of inexpensive manufacture. Further, the present scraper mounting arrangement allows the scraping elements to be readily removed from the agitator for cleaning of the scraping elements and of the agitator. The present scraper mounting arrangement can also be used to mount scraping elements to agitators of widely varying structure whether horizontally or vertically or diagonally mounted for rotation within a mixing kettle.

SUMMARY OF THE INVENTION

The invention provides a mounting arrangement useful for holding a scraping element on a mixing agitator, the structure of the invention mounting the scraping element such that the scraping element is free to pivot within a predetermined arc sufficient to maintain a scraping edge of the scraping element in contact with interior surfaces of a kettle or container within which the agitator is rotating. The mounting arrangement includes a spring element which resiliently biases the scraping edge of the scraping element against the interior surfaces of the kettle, the scraping element thus acting to "track" the surfaces of the kettle even when the kettle surfaces are not manufactured to an expected contour. The mounting arrangement of the invention can mount scraping elements to agitators of differing structure by direct mounting to a portion of the agitator or by mounting a plate member carrying the mounting arrangement to a portion of the agitator. Whether the agitator is mounted for horizontal, vertical or diagonal rotation within a kettle, the present mounting arrangement functions to assure scraping contact between a scraping element and kettle walls to prevent adhesion, sticking or "burn-on" of materials being mixed, heated or cooked within the kettle. In certain orientations within a kettle, the scraping elements further act to lift materials from the bottom of a kettle to the top of the body of material being mixed, thereby producing a uniform dispersion of the materials within the kettle. In those mixing situations involing solids suspended in a liquid and especially fragile solid pieces of food material suspended in a liquid, the scraping elements assist in maintenance of a uniform dispersion without damage to the suspended solids. Such a mixture of suspended solids in liquids can thus be heated, cooked or mixed within a kettle or dispensed from the kettle and remain uniform in consistency.

The scraping elements mounted to an agitator according to the invention primarily act to uniformly scrape the inner surfaces of a kettle regardless of the rotational orientation of the agitator within the kettle. Contoured scraping edges of the scraping elements are arcuately shaped to conform to localized wall surface portions of the kettle. All of the interior hemispherical surfaces of a kettle can be scraped during each rotation of the agitator with assurance that the kettle surfaces will be scraped even if portions of the kettle walls are "out of round". This assured scraping contact is accomplished by the pivotal mounting of each scraping element on the agitator and by the resilient biasing of the scraping element toward the kettle wall by means of a spring element acting against the scraping element to cause pivotal motion of the scraping element when the scraping element is otherwise unrestrained. The present mounting arrangement finds utility with mixing agitators of diverse structure and rotational orientation, it being the intent of the invention to provide a structurally simple and inexpensive mounting arrangement capable of mounting a scraping element on essentially any agitator. The invention further contemplates a scraper mounting arrangement wherein the scraping elements are readily demountable from essentially any agitator to facilitate cleaning of the scraping elements and of the agitator.

Accordingly, it is an object of the invention to provide a scraper mounting arrangement capable of mounting a scraping element to an agitator of diverse structural conformation and which will facilitate contact between a scraping edge of the scraping element and interior wall surfaces of a kettle within which the agitator is operable.

It is another object of the invention to provide a structurally simple and inexpensive mounting arrangement for scraping elements operable with agitators of diverse structure and utility and which acts to bias the scraping element into contact with interior wall surfaces of a kettle within which the agitator is operable.

It is a further object of the invention to provide a scraper mounting arrangement capable of mounting a scraping element to an agitator of diverse structure and utility and which allows rapid and ready disassembly of the scraping elements from the agitator to facilitate cleaning of the scraping element and of the agitator.

Further objects and advantages of the invention will become more readily apparent in light of the following detailed description of the preferred embodiments.

DESCRIPTION OF THE PREFERRED EMBODIMENTS

The disclosure of U.S. Pat. Nos. 4,571,091; 4,790,667 and 4,818,116 are incorporated hereinto by reference.

Figure 1:
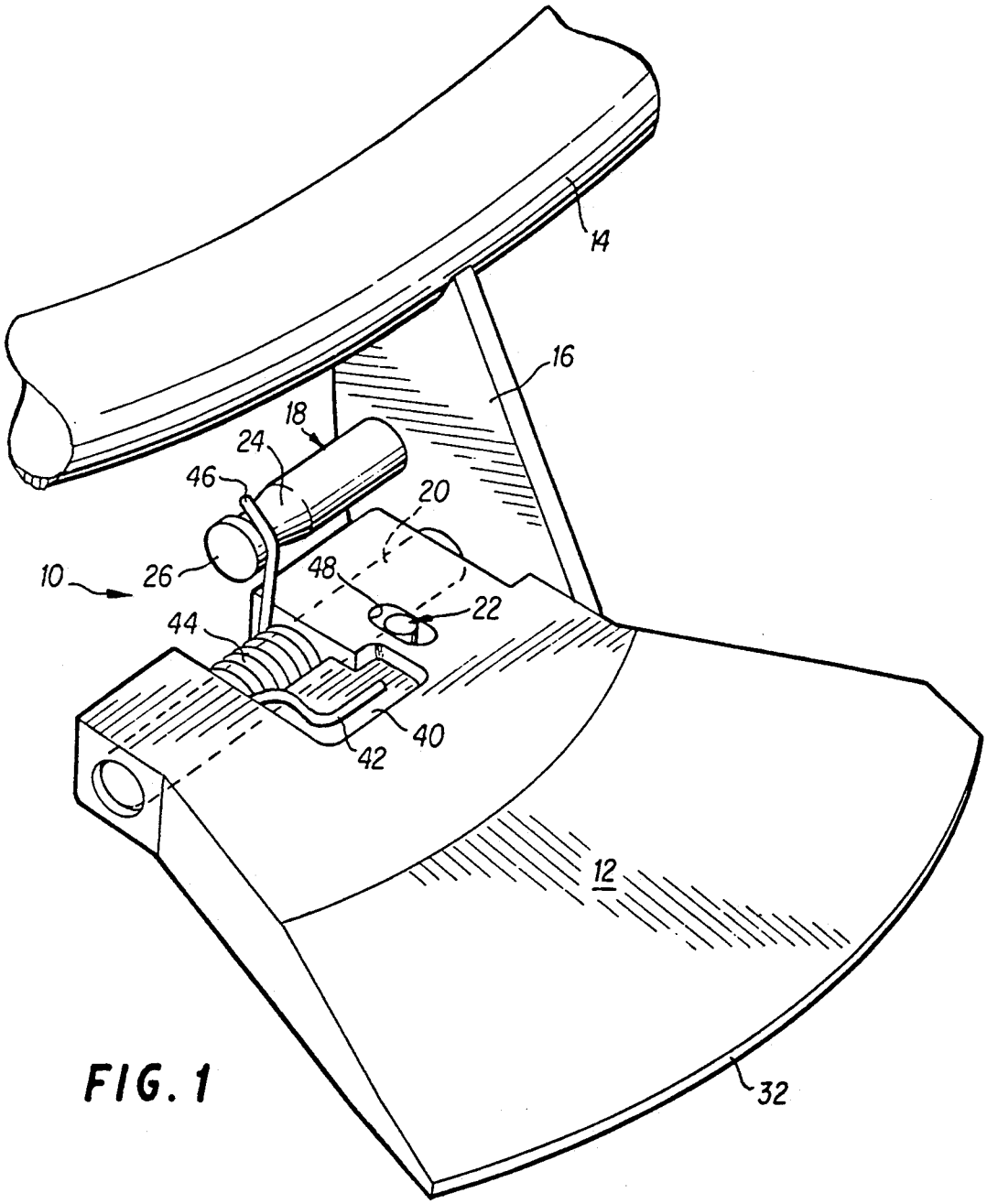
FIG. 1 is a perspective view taken from a first aspect angle of a scraping element and a mounting arrangement for mounting the scraping element to a portion of an agitator.

Referring now to the drawings, and particularly to FIG. 1, a scraper mounting arrangement is seen generally at 10 to mount a scraping element 12 to a portion of agitator 14. As is seen in the drawings, the agitator 14 can resemble or be identical to the agitator shown and described in U.S. Pat. No. 4,790,667. When used with an agitator such as the agitator of 4,790,667, a plate member 16 is desirably used to connect the scraper mounting arrangement 10 to a portion of the agitator 14. It should be understood that a plurality of the scraper mounting arrangements 10 would be utilized to mount a plurality of the scraping elements 12 in order that the full interior wall surfaces of a kettle (not shown) can be scraped such as is described at length in U.S. Pat. No. 4,790,667. When the scraper mounting arrangement 10 is used to mount one of the scraping elements 12 to an agitator such as the agitator shown and described in U.S. Pat. No. 4,571,091, various portions of the scraper mounting arrangement 10 can be directly mounted to portions of the agitator, such as the "paddle wheel" portions of the agitator of 4,571,091. A brief description of such a mounting arrangement will be provided hereinafter. However, for purposes of illustration, the scraper mounting arrangement 10 of the present invention will be shown and described in relation to an agitator structure such as the agitator of U.S. Pat. No. 4,790,667.

The plate member 16 mounting the scraper mounting arrangement 10 is preferably arcuate in contour along a first side and essentially straight along a side opposite the first side, the two sides tapering in a rounded distal end portion. The contours of the plate member 16 can be other than as shown in the drawings depending upon the location of the scraping element 12 on the agitator 14. In essence, the plate member 16 is shaped to accommodate the exigencies of its location on the agitator 14 to allow convenient fitting within its operating environment. A total of three pin elements extend substantially perpendicularly from the plate member 16, these pin elements being preferably welded to the plate member 16 or otherwise joined thereto in a manner which allows accommodation of substantial stresses acting on the pin elements transversely to the longitudinal axes of the pin elements.

The pin elements are best identified as spring loading pin 18, mounting pin 20 and stop pin 22.

Figure 2:
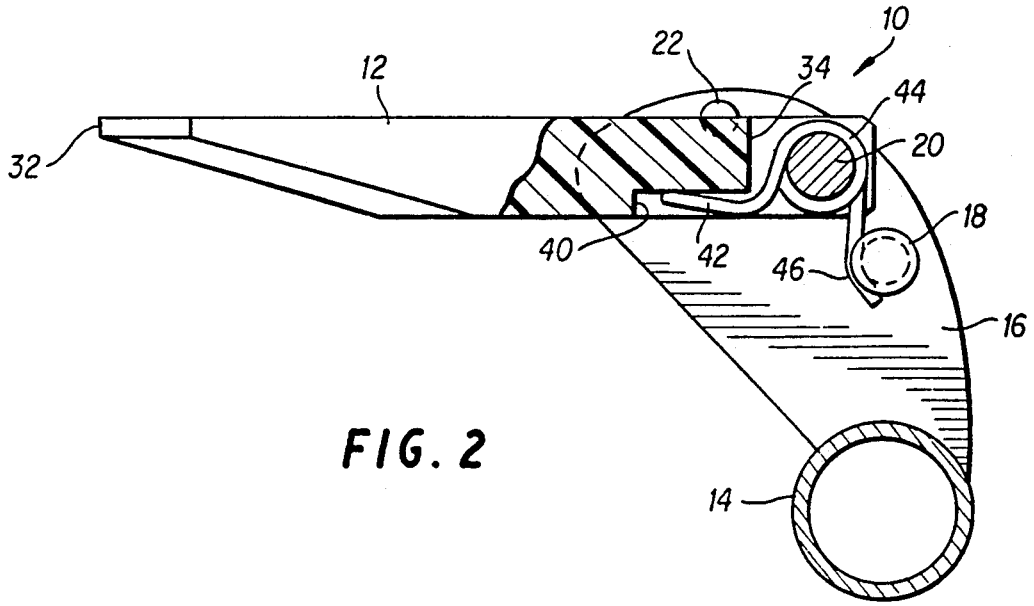
FIG. 2 is an elevational view in partial section of the scraper mounting arrangement and scraping element of FIG. 1.
Figure 3:
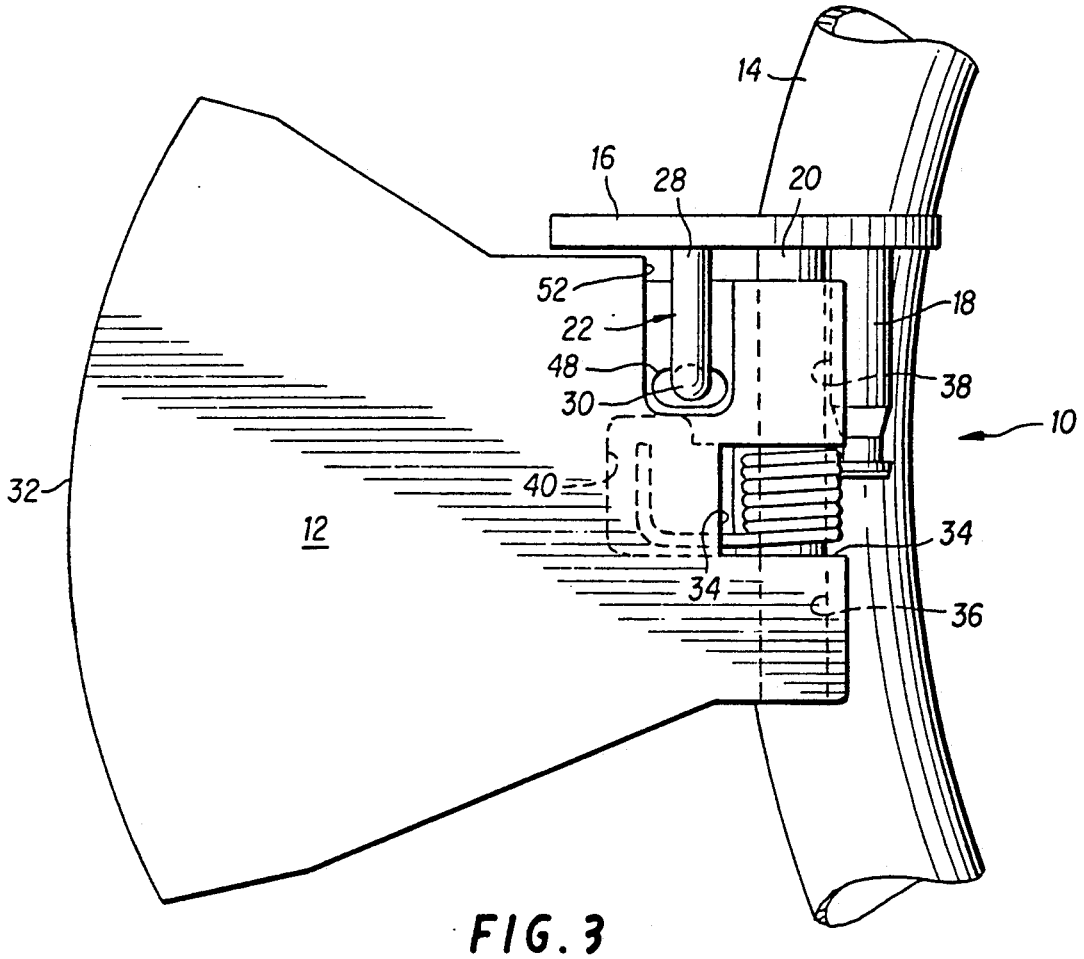
FIG. 3 is a plan view of the structure of FIG. 1.
Figure 4:
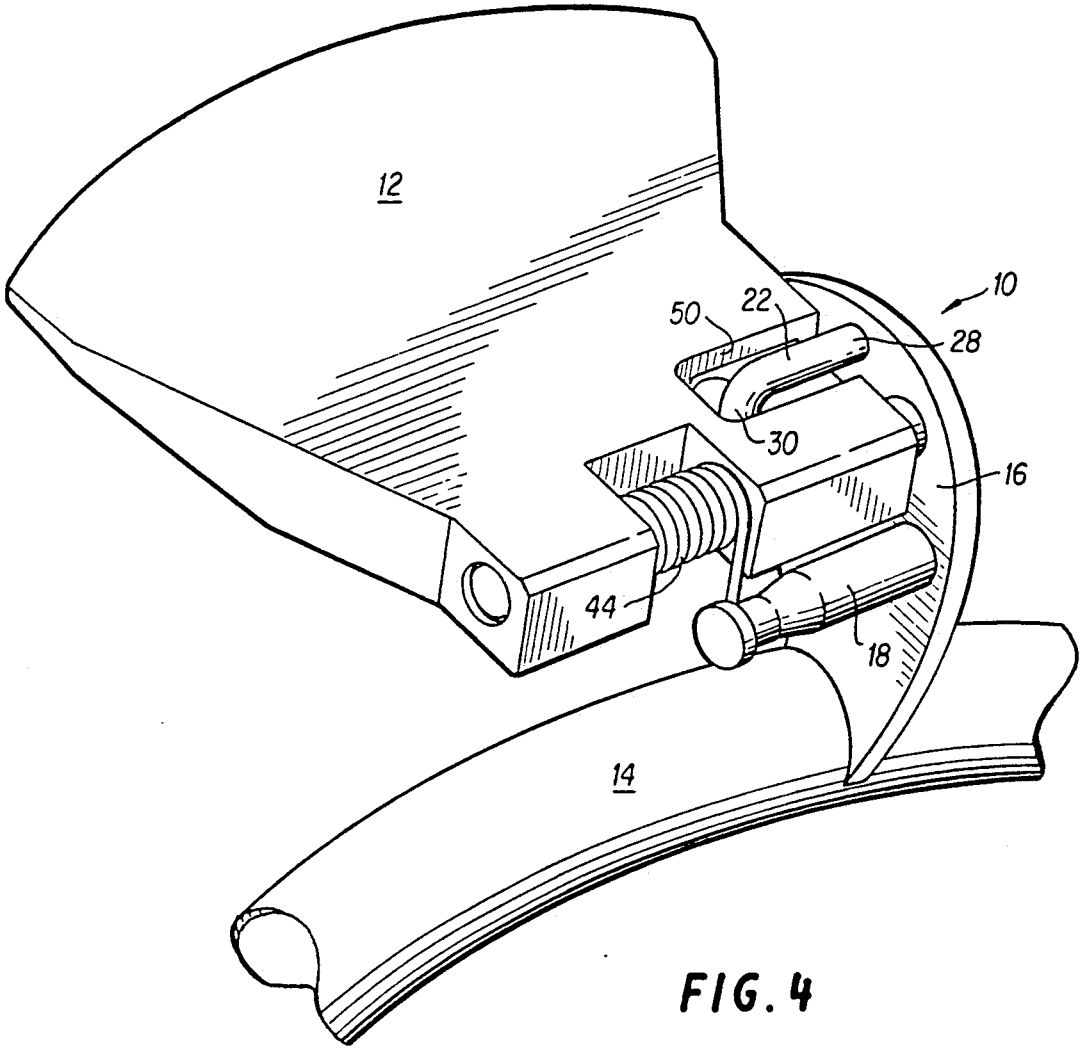
FIG. 4 is a perspective view taken from a second aspect angle opposite the first aspect angle of the scraping element and mounting arrangement of FIG. 1.

As is seen best in FIG. 2, the pins 18, 20 and 22 are mounted to the plate member 16 along an arc, the contour of this arc being chosen for convenience and being capable of variance to accommodate the location of the scraping element 12 on the agitator 14. In an arrangement such as is necessitated by mounting on the agitator 14, the stop pin 22 is disposed distally of the agitator 14 with the spring loading pin 18 being proximal to the agitator 14. Substantially medially between the pins 18 and 22, the mounting pin 20 is located to receive the scraping element 12 thereon. The distances between and relative locations of the pins 18, 20 and 22 can vary depending upon the degree of pivotal arc which is desired and necessary for tracking of interior surfaces of a kettle (not shown) and for disassembly and assembly of the scraping element 12 on the mounting pin 20.

The spring loading pin 18 can conveniently be formed with a cylindrical conformation proximally to the plate member 16. Distally, the spring loading pin 18 tapers to a reduced neck portion 24 and terminates in a plate-like circular cap 26. As will be noted hereinafter, the neck portion 24 and cap 26 act to maintain a free end of a coil spring in place on the spring loading pin 18 and provides a surface against which the spring can exert a force.

The mounting pin 20 is substantially cylindrical in conformation throughout its length. The stop pin 22 is L-shaped in conformation with proximal leg 28 extending from the plate member 16 and distal leg 30 extending perpendicular to proximal leg 28 and parallel to the plane of the plate member 16. The longitudinal axes of the spring loading pin 18, the mounting pin 20 and the proximal leg 28 of the stop pin 22 are substantially parallel to each other in a preferred embodiment. The distal leg 30 of the stop pin 22 is seen in the drawings to lie in a plane defined by the longitudinal axes of the proximal leg 28 and of the distal leg 30, this plane being substantially parallel to the longitudinal axis of the mounting pin 20. Further, the distal leg 30 of the stop pin 22 extends in a direction "toward" the portion of the agitator 14 mounting the plate member 16 for a purpose to be described hereinafter.

The scraping element 12 is formed of a material such as Teflon, a registered trademark of the Dupont de Nemours Corporation, the material being a halo-substituted hydrocarbon such as is well known in the art. The scraping element 12 can have a shape which can vary depending upon the position of the scraping element 12 on the agitator 14 as can be understood from a review of U.S. Pat. No. 4,790,667. Essentially, that portion of the scraping element 12 which contacts the inner walls of a kettle (not shown), can be contoured to accommodate the particular shape of the kettle walls at the location which is scraped by the particular scraping element 12. That portion of the scraping element 12 which contacts the kettle walls is referred to as scraping edge 32 and is typically arcuate in most scraping situations. The scraping element 12 shown in the drawings is provided for illustration only and is not limiting as to the shape of the scraping element 12 or of the scraping edge 32. As can readily be seen in the drawings, the scraping element 12 tapers from a narrowmost thickness at the scraping edge 32 to a maximum thickness substantially at mid-body. The scraping element 12 also tapers from each end of the scraping edge 32 toward mid-body of the scraping element 12. Along the side of the scraping element 12 opposite the scraping edge 32 a cutout 34 is formed medially of the length of the scraping element 12, aligned bores 36 and 38 being formed in the body of the scraping element 12 with the bores 36 and 38 aligning through the cutout portion 34. The bores 36 and 38 receive the mounting pin 20, the pin 20 also extending through the cutout portion 34. On that face of the scraping element 12 which faces the spring loading pin 18 when assembled, a recess 40 is formed which receives a recurved end 42 of coil spring 44, the opposite end 46 of the spring 44 extending toward and contacting the neck portion 24 of the spring loading pin 18. As can readily be seen, the body of the coil spring 44 is received on the mounting pin 20 and is located within the cutout portion 34 of the scraping element 12. The spring 44 acts to bias the scraping element 12 outwardly from the agitator 14 and essentially toward the stop pin 22. The stop pin 22 functions to prevent pivotal movement of the scraping element 12 about the mounting pin 20 beyond a desired arc.

The scraping element 12 is further provided with an aperture 48 which receives the distal leg 30 of the stop pin 22, the distal leg 30 being movable within the aperture 48 to act as a guide for positively maintaining the scraping element 12 in position. The scraping element 12 has a recess 50 cut into that face of the scraping element 12 opposite the face having the recess 40, the recess 50 communicating with the aperture 48 and extending to the edge of the scraping element 12. When the scraping element 12 contacts the proximal leg 28 of the stop pin 22, the leg 28 actually fits into the recess 50 and contacts the floor portion of the recess 50. Side cutout 52 is provided in that side of the scraping element nearmost the plate 16 in order to facilitate a desired arcuate pivotal range of the scraping element 12.

The scraping element 12 can be removed from the scraper mounting arrangement 12 through use of any tool (not shown) having a hook element capable of engaging spring end 46 and decoupling said spring end 46 from the spring loading pin 18. Once the spring end 46 is removed from engagement with the spring loading pin 18, the scraping element 12 can be pivoted back toward the agitator 14 to disengage the distal leg 30 of the stop pin 22 from the aperture 48. The scraping element 12 and spring 44 can then be easily removed from the mounting pin 20. Accordingly, the scraping element 12 can be readily and rapidly disengaged from the scraper mounting arrangement 10 for cleaning of the scraping element 12 and of the agitator 14.

It should be understood that the invention can be embodied in structure other than as is explicitly shown in the drawings. In particular, the spring loading pin 18 could be functionally embodied other than as explicitly shown such as by mounting of the pin 18 from the agitator 14 itself in an orientation extending toward the coil spring 44 as it is mounted on the mounting pin 20. In such an arrangement, the spring end 46 could extend toward engagement with such structure which would act to give the coil spring a surface to "push" upon at the end opposite the recurved end 42 of the coil spring 44 which pushes upon the scraping element itself. Similarly, the stop pin 22 could be otherwise configured to provide a stop function even though the arrangement shown in the drawings and described hereinabove provides not only a stop function but a guiding function as well. As has been referred to hereinabove, the scraper mounting arrangment 10 of the invention can be mounted directly to a portion of an agitator such that one end of the spring 44 would be capable of biasing directly against the agitator. Accordingly, the invention contemplates structural arrangements of varying description which fall within the scope of the appended claims.

What is claimed is:

1. In combination with an agitator mounted for rotation within a container within which materials are being mixed, apparatus mounted on the agitator for scraping walls of the container, comprising:

scraper means positioned in scraping relation with at least portions of the walls of the container for preventing adhesion of the materials to said walls, the scraper means having aligned bores formed in one end and a cutout portion disposed between the aligned bores, the scraper means having an aperture formed therein;

mounting means carried by the agitator and being received within the aligned bores of the scraper means for mounting the scraper means for pivotal motion relative to the agitator;

adjusting means carried by the agitator for constantly adjusting the position of the scraper means to accommodate surface contours of the walls and to accommodate surface wear of at least portions of the scraper means in order to maintain the scraper means in scraping relation with said walls on rotation of the agitator, the adjusting means comprising spring loading pin means spaced from the mounting means and carried by the agitator for providing a surface against which a force can be directed, the adjusting means further comprising a coiled spring having a substantially cylindrical body portion, a first end and a second end, the body portion of the coiled spring being disposed within the cutout portion of the scraper means, the mounting means being received through the coil body portion, the first end of the coiled spring biasing against the scraper means and the second end of the coiled spring biasing against the spring loading pin means, the coiled spring thereby exerting a bias against the scraper means to force the scraper means into scraping relation with the walls of the container and to hold the scraper means under tension; and, stop means carried by the agitator for limiting the pivotal motion of the scraper means on the mounting means to a predetermined arcuate angle, the stop means comprising an L-shaped pin having a proximal leg mounted to the agitator and a distal leg receivable within the aperture formed in the scraper means on pivoting of the scraper means toward the stop means, portions of the scraper means contacting the proximal leg to prevent further pivoting motion of the scraper means, the scraper means being formed with a recess communicating with the aperture in the scraper means, the proximal leg of the stop means being received into the recess on pivoting of the scraper means toward the stop means, the bottom wall of the recess contacting the proximal leg of the stop means to prevent further pivoting motion of the scraper means.

2. The combination of claim 1 wherein the mounting means further comprise a mounting pin and a base plate, the base plate being planar in conformation and being joined to the agitator and extending outwardly therefrom, the mounting pin being attached to the base plate and extending perpendicularly therefrom, the mounting pin being received through the bores formed in the scraper means and thus mounting the scraper means for pivotal motion.

3. The combination of claim 2 wherein the spring loading pin means comprises a pin mounted to the base plate and extending perpendicularly therefrom and parallel to and spaced from the mounting pin.

4. The combination of claim 3 and further comprising:

stop means carried by the base plate for limiting the pivotal motion of the scraper means on the mounting pin to a predetermined arcuate angle.

5. The combination of claim 2 and further comprising:

releasing means mounted to the base plate for releasably holding the scraper means on the mounting pin.

6. The combination of claim 1 and further comprising:

means carried by the agitator for releasably holding the scraper means on the mounting means.

7. The combination of claim 1 wherein the scraper means has an edge portion contoured to fit the contours of the walls which are scraped by the scraper means.

8. In combination with an agitator mounted for rotation within a container within which materials are being mixed, apparatus mounted on the agitator for scraping walls of the container, comprising:

scraper means positioned in scraping relation with at least portions of the walls of the container for preventing adhesion of the materials to said walls, the scraper means having aligned bores formed in one end and a cutout portion disposed between the aligned bores, the scraper means further having a recess formed adjacent to and communicating with the cutout portion, the recess receiving the first end of the coiled spring;

mounting means carried by the agitator and being received within the aligned bores of the scraper means for mounting the scraper means for pivotal motion relative to the agitator; and, adjusting means carried by the agitator for constantly adjusting the position of the scraper means to accommodate surface contours of the walls and to accommodate surface wear of at least portions of the scraper means in order to maintain the scraper means in scraping relation with said walls on rotation of the agitator, the adjusting means comprising spring loading pin means spaced from the mounting means and carried by the agitator for providing a surface against which a force can be directed, the adjusting means further comprising a coiled spring having a substantially cylindrical body portion, a first end and a second end, the body portion of the coiled spring being disposed within the cutout portion of the scraper means, the mounting means being received through the coiled body portion, the first end of the coiled spring biasing against the scraper means and the second end of the coiled spring biasing against the spring loading pin means, the coiled spring thereby exerting a bias against the scraper means to force the scraper means into scraping relation with the walls of the container and to hold the scraper means under tension.

9. The combination of claim 8 wherein the first end of the coil spring comprises a first portion extending from the body portion of the coil spring substantially normally thereto and a second portion which extends normally to the first portion and recurs in spaced relation from the body of the coil spring to be substantially parallel thereto, the recess in the scraper means being contoured to receive the first and second portions of the first end of the coil spring, the first end of the coil spring biasing against the floor of the recess.

10. The combination of claim 8 and further comprising:

stop means carried by the agitator for limiting the pivotal motion of the scraper means on the mounting means to a predetermined arcuate angle.

11. The combination of claim 10 wherein the scraper means has an aperture formed therein and the stop means comprises an L-shaped pin having a proximal leg mounted to the agitator and a distal leg receivable within the aperture on pivoting of the scraper means toward the stop means, portions of the scraper means contacting the proximal leg to prevent further pivoting motion of the scraper means.

12. The combination of claim 11 wherein the recess in the scraper means communicates with the aperture in the scraper means, the proximal leg of the stop means being received into the recess on pivoting of the scraper means toward the stop means, the bottom wall of a recess contacting the proximal leg of the stop means to prevent further pivoting motion of the scraper means.

13. The combination of claim 8 wherein the mounting means further comprise a mounting pin and a base plate, the base plate being planar in conformation and being joined to the agitator and extending outwardly therefrom, the mounting pin being attached to the face plate and extending perpendicularly therefrom, the mounting pin being received through the bores formed in the scraper means and thus mounting the scraper means for pivotal motion.

14. The combination of claim 13 wherein the spring loading pin means comprises a pin mounted to the base plate and extending perpendicularly therefrom and parallel to and spaced from the mounting pin.

15. The combination of claim 14 and further comprising:

stop means carried by the base plate for limiting the pivotal motion of the scaper means on the mounting pin to a predetermined arcuate angle.

16. The combination of claim 13 and further comprising:

releasing means mounted to the base plate for releasably holding the scraper means on the mounting pin.

17. The combination of claim 8 and further comprising:

means carried by the agitator for releasably holding the scraper means on the mounting means.

18. The combination of claim 8 wherein the scraper means has an edge portion contoured to fit the contours of the walls which are scraped by the scraper means.

* * * * *